United States Patent [19]

Bobb et al.

[11] 4,350,855

[45] Sep. 21, 1982

[54] ELECTRICAL SWITCH ASSEMBLY

[75] Inventors: Clifford F. Bobb, Carlisle; Norwood C. Graeff, Harrisburg, both of Pa.

[73] Assignee: AMP Incorporated, Harrisburg, Pa.

[21] Appl. No.: 218,853

[22] Filed: Dec. 22, 1980

[51] Int. Cl.[3] ..... H01H 1/26

[52] U.S. Cl. ..... 200/292; 200/283

[58] Field of Search ..... 200/6 C, 283, 292, 245, 200/246, 159 A

[56] References Cited

U.S. PATENT DOCUMENTS

| | | | |
|---|---|---|---|
| 4,010,339 | 3/1977 | Owen et al. | 200/292 |
| 4,144,430 | 5/1979 | Coldren et al. | 200/245 |
| 4,152,556 | 5/1979 | Schadow | 200/283 |

*Primary Examiner*—John W. Shepperd
*Attorney, Agent, or Firm*—Allan B. Osborne

[57] ABSTRACT

The present invention relates to a single piece, stamped and formed electrical switch assembly which is intended to be mounted on a printed circuit board. More particularly, the switch assembly comprises a U-shaped member with one arm comprising an elongated cantilever spring blade and the other arm having means for mounting, and a detachable contact post attached to the one arm by a break-away strap. Additionally, means are included for holding the spring blade in a stationary open position during shipping, handling, mounting, and cleaning of the assembly.

1 Claim, 3 Drawing Figures

ELECTRICAL SWITCH ASSEMBLY

BACKGROUND OF THE INVENTION

1. The Field of the Invention

The disclosed invention falls in that class of inventions relating to momentary switches and more particularly, switches wherein the spring blade and contact post are manufactured and installed as an integral, one-piece product.

2. The Prior Art

U.S. Pat. No. 4,144,430 exemplifies the art of momentary switches comprising an elongated cantilever spring blade. The invention disclosed in the subject patent is an elongated spring blade having a mounting end and a free end. An integral mounting plate extends alongside the blade from the mounting end to an intermediate location. A mounting pin is formed at the mounting end by cooperating leg portions depending from the plate and blade. A support pin depends from the mounting plate inwardly from the mounting end. Further, the mounting plate provides laterally extending flanges which support the spring blade on printed circuit boards on which the device is mounted. The devices disclosed are manufactured as a continuous strip and can be inserted into circuit boards by automatic insertion machines.

SUMMARY OF THE INVENTION

The present invention is an electrical switch assembly; i.e., a one-piece stamped and formed assembly having an integral, cantilever spring blade and a contact post. After installation onto a printed circuit board, a strap connecting the two is broken away so that the spring blade is independent of the post and can be moved out of electrical engagement therewith. Posts on the assembly are inserted into the circuit board and into electrical engagement with conductive traces thereon. Additionally, the assembly includes removable retaining means which secures the cantilever spring blade against movement during shipping, handling, and mounting thereof on a circuit board. The disclosed invention is a normally closed, momentary type switch useful in cameras and the like.

The one piece assembly is manufactured as a continuous strip from flat conductive stock.

DESCRIPTION OF THE INVENTION

Figure 1:
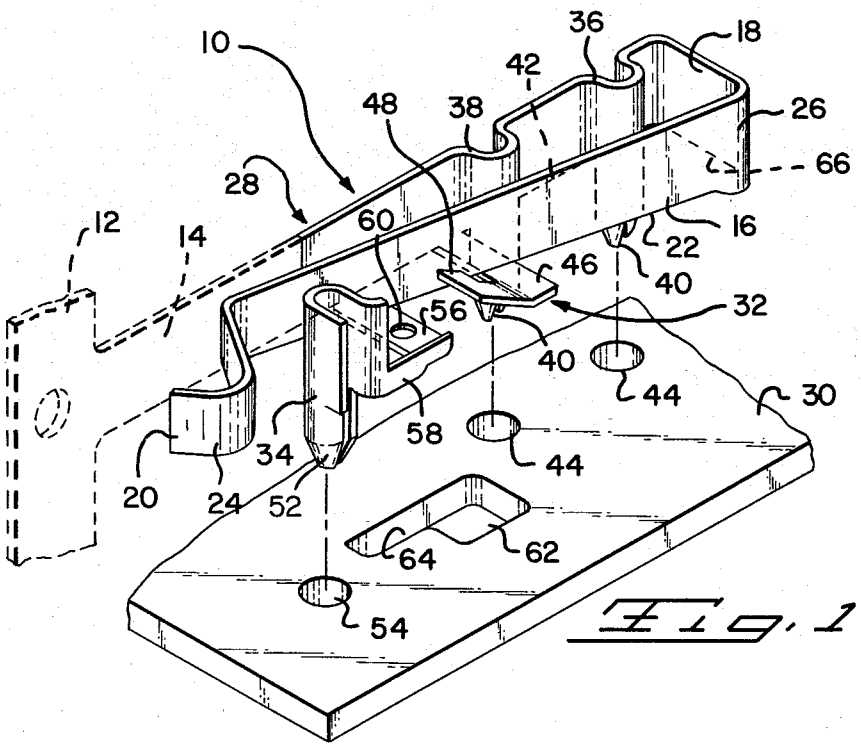
FIG. 1 is a perspective view of an electrical switch assembly stamped and formed in accordance with the invention.

FIG. 1 shows, in perspective, the one piece electrical switch assembly 10 constructed in accordance with the concepts of the present invention. The assembly is preferably made in continuous strip from coplanar stock metal. Accordingly, a carrier strip 12 and attaching strap 14 are shown in phantom to indicate such manufacturing method. The strip and strap are shown attached to the assembly in one of several acceptable places.

Assembly 10 is generally U-shaped with one arm forming cantilever spring blade 16. The blade width decreases from its attachment to bight 18 outwardly to free end 20. The reduction comes from removing metal from lower edge 22 of the blade. Inwardly from and out to free end 20, the blade is formed to provide a asymmetrically curved, laterally projection section 24.

The metal, preferably copper alloy, and the length of blade 16, combines to permit unstrained, horizontal swinging of the blade about its attachment with the bight. The point of attachment, which functions as a hinge, is indicated by reference numeral 26.

Another arm 28 of the assembly provides means for mounting spring blade 16 to printed circuit board 30 and also carries spring blade retaining means 32 and contact post 34.

Two spaced apart pins 36 and 38, formed out of arm 28, have free ends 40 which extend below lower edge 42 of the arm (shown in phantom in FIG. 1). These free ends are tapered for easy insertion into holes 44 in circuit board 30.

Spring blade retaining means 32, located just in front of pin 38 on arm 28, consists of a strap 46 which is perpendicular to arm 28 and which extends past spring blade 16 under lower edge 22 thereon. An L-shaped finger 48, attached to strap 46, extends forwardly and obliquely upwardly therefrom. The free end of the finger is bevelled as pointed out by reference numeral 50 in FIG. 3, to conformably bear against spring blade 16 which is held at an angle relative to arm 28 by the finger; i.e., as stamped and formed spring blade 16 is parallel to arm 28; thereafter, it is swung inwardly towards arm 28 and finger 48 is bent up to retain the spring blade in the angled position shown in FIG. 1.

Contact post 34 is U-shaped and includes a tapered free end 52 for easy insertion into hole 54 in circuit board 30. The post is attached to strap 56 by an intermediary member 58 which places the post forwardly of the strap. The strap itself it attached to arm 28 and extends normally thereto, passing under and beyond spring blade 16. The distance between the contact post and leg 28 is less than the distance between the arm and spring blade as stamped and formed. A hole 60 in the strap provides a weakened point for breaking it to isolate the post from the rest of the assembly.

Printed circuit board 30 includes an opening 62 which has an extension 64. The board also has separate conductive traces (not shown) which are connected to one or both holes 44 and hole 54. Preferable holes 44 and 54 are plated-through to the traces.

FIG. 1 shows assembly 10 as an integral one piece device. Spring blade 16 is being held in towards arm 28 by retaining means 32.

Figure 2:
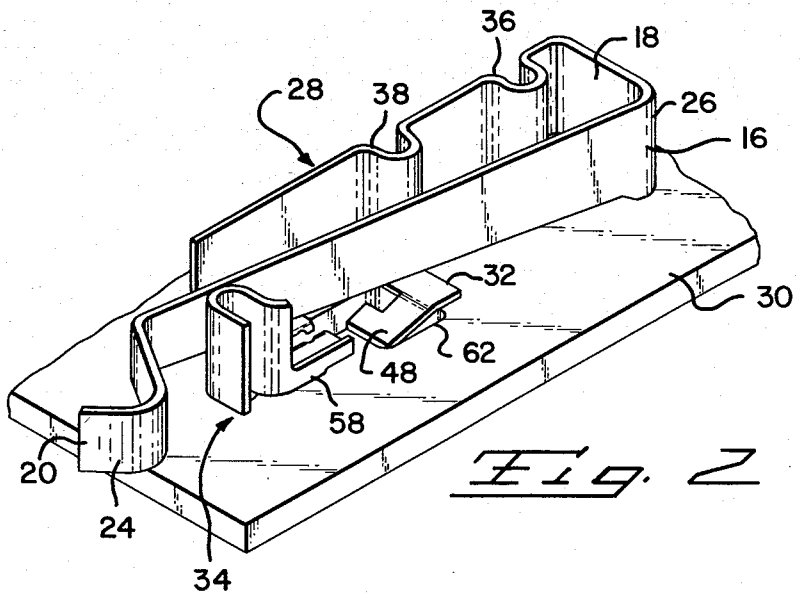
FIG. 2 is a perspective view of the assembly of FIG. 1 subsequent to being installed onto the board and after the removal of a strap which separates the assembly into a two-piece momentary, normally open switch and removal of the spring blade retaining means.

In FIG. 2, the assembly has been mounted on circuit board 30 and has been turned into a two piece, normally closed electrical switch.

The method or procedure for mounting assembly 10 on the board preferably includes first breaking carrier strip 12 and strap 14 away from arm 28. The free ends of pins 36 and 38 and contact post 34 are next simultaneously inserted into holes 44—44 and 54 respectively. The free ends may be soldered to the board if preferred. Thereafter strap 56 is broken and the broken ends turned down into extension 64. This ensures that the two ends will not inadvertantly contact each other. Breaking contact post 34 away from the rest of the assembly turns it into a two piece switch. Then, by turning finger 48 down into opening 62, spring blade 16 is released to swing back towards its original stamped and formed position (not shown) which was parallel to arm 28. Before reaching that position, however, the spring blade abuts up against contact post 34 as shown in FIG. 2. The two piece electrical switch is now a normally closed switch with the conductive traces connected to holes 44 and 54 being in electrical contact. By pushing in on section 24 near the free end of spring blade 16, the electrical contact is broken. The switch is of the momentary type in that upon releasing pressure on section 24, the spring blade will automatically return to contact post 34 by reason of its being biased during the forming thereof.

By turning finger 48 down into opening 62, any tendency for it to spring back up into inference contact with spring blade 16 is removed.

Figure 3:
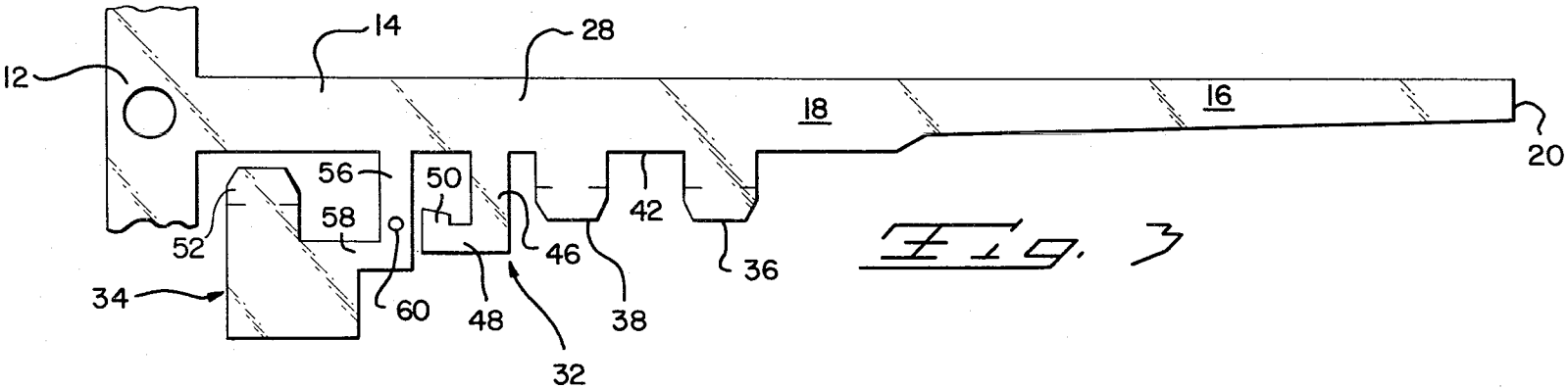
FIG. 3 is a plan view of a blank from which the switch assembly of FIG. 1 is formed.

FIG. 3 shows a blank of assembly 10 before it is formed. The reference numerals thereon are the same as used in FIGS. 1 and 2 for the formed components.

The present invention may be subject to many modifications and changes without departing from the spirit or essential characteristics thereof. The present embodiment is therefore to be considered in all respects as illustrative and not restrictive of the scope of the invention.

What is claimed is:

1. An electrical switch assembly of conductive material for being mounted as a one piece assembly onto a circuit board or the like, the assembly comprising:

a. a first arm with a post depending therefrom for being inserted into a circuit board;

b. a vertically extending contact post detachably attached to the first arm to change the one piece switch assembly into a two piece switch assembly after being mounted on the circuit board and with a free end of the post being adapted for insertion into a circuit board;

c. a second, resilient arm spaced from and extending parallel to the first arm and hingedly connected thereto at one end to comprise a swingable, cantilever spring blade biased to bear against said contact post; and d. removable retaining means for holding the second arm away from the contact post during the mounting of the switch assembly onto a circuit board and thereafter removing said retaining means so that the blade is normally in contact with the contact post.

* * * * *